US005517721A

United States Patent [19]

Roth et al.

[11] Patent Number: 5,517,721

[45] Date of Patent: May 21, 1996

[54] DEVICE FOR HOLDING DOORS AND WINDOWS

[76] Inventors: Martin K. Roth; Emil Roth, both of P.O. Box 254, Caloundra, Queensland, 4551, Australia

[21] Appl. No.: 267,062

[22] Filed: Jun. 27, 1994

[51] Int. Cl.[6] ..... E05F 5/06

[52] U.S. Cl. ..... 16/86 R; 16/86 A

[58] Field of Search ..... 16/8 S, 86 R, 16/86 A

[56] References Cited

U.S. PATENT DOCUMENTS

| | | | |
|---|---|---|---|
| 2,760,224 | 8/1956 | Hennelly | 16/86 A |
| 2,819,921 | 1/1958 | Solari | 16/86 A |
| 3,082,028 | 3/1963 | Werle | 16/86 R |
| 3,328,061 | 6/1967 | Whistler, Sr. et al. | 16/86 A |
| 3,701,557 | 10/1972 | Centofante | 16/86 A |
| 4,218,807 | 8/1980 | Snow | 16/86 A |

*Primary Examiner*—W. Donald Bray
*Attorney, Agent, or Firm*—Robbins, Berliner & Carson

[57] ABSTRACT

A device for releasably holding a door or window comprising two components. The first component (1) is attached to the door or window and the second component (7) is attached to the floor or wall. The two components are releasably engageable with each other. One of the components has a means (10) to cushion the opening force of a door or window, limited movement of an opened door or window, and cushion and direct the engagement of one component with the other. This device has the advantages of releasably holding a door or window and cushioning the door or window during engagement.

5 Claims, 2 Drawing Sheets

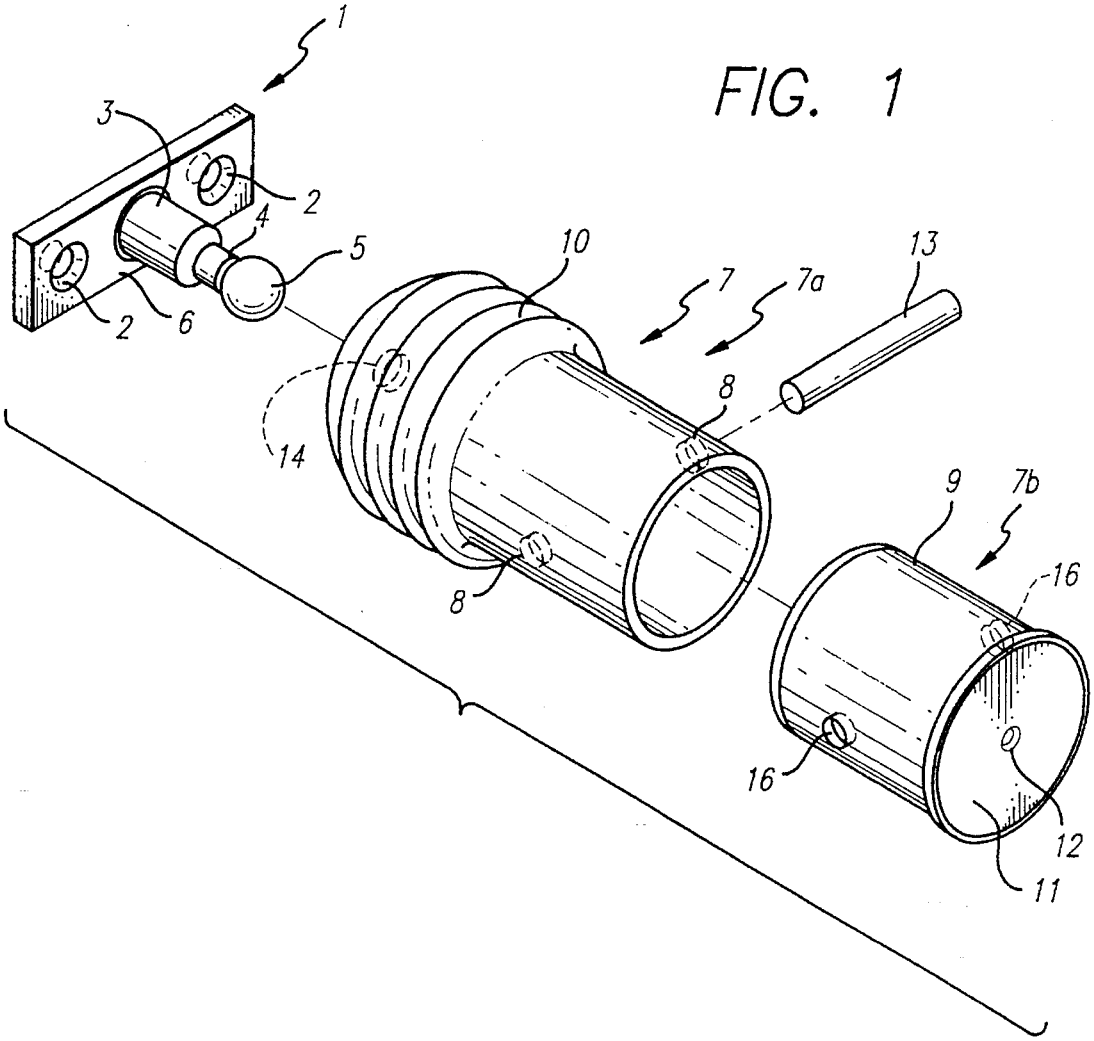
FIG. 1
FIG. 2
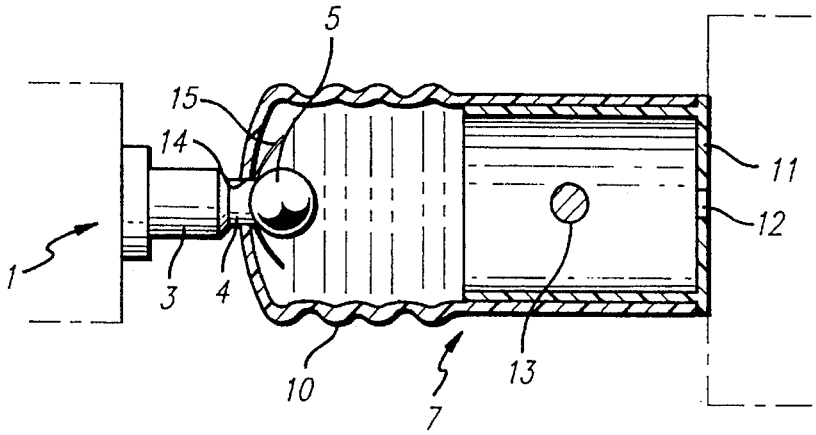

DEVICE FOR HOLDING DOORS AND WINDOWS

THIS INVENTION relates to a device for holding a door, window or the like.

The invention will be described by way of example with reference to a device for holding a door but it should be appreciated that the device of the invention may be used to hold other suitable items and the description in relation to doors is given by way of example only.

Doors may be held by a number of devices and include those devices which are attached to the door and/or to a corresponding position on the wall or floor. Doors have traditionally been held by cabin hooks where the hook component is attached to a wall or skirting board and the eye component is attached to the back of the door. The cabin hooks however have no means in which to cushion the door during engagement nor do they rigidly hold the door to prevent the door from movement albeit limited movement. The cabin hooks also require a person to physically engage the hook with the eye.

More recently, door clips have been used to retain doors. Door clips have a clip which usually is attached to the back of a door and a corresponding knob portion which is attached to a wall and engageable with the clip. When the clip and the knob portion are engaged, the door is rigidly held so that the door cannot move unless released from the knob portion. Like the cabin hooks however, the door clips do not serve to cushion the door during engagement.

One disadvantage with the hook and eye arrangement is the need to manually remove the hook when wishing to release the door or window.

This has been overcome in part by the door clip. However, one disadvantage with door clips is that they do not allow limited movement of the door or window (i.e. provide a cushioning effect). Thus with wind gusts, the door or window may inadvertently be released from the clip. To overcome this, the clip may be designed to more securely hold the door but this makes it difficult for elderly or incapacitated persons to operate the door. A second disadvantage of known hold back devices is that the two parts must be accurately aligned to mate together. There is little scope for adjustment.

It is an object of the present invention to provide a device which may both releasably hold a door and cushion the door during engagement and thus may overcome the disadvantages of the current door stops and holding devices.

According to the present invention there is provided a door stop comprising:

(i) a door mountable component having a base portion, a neck portion and a head portion, wherein the width of the neck portion is smaller than the width of the head portion, and wherein the base portion provides an anchor point to a door;

(ii) a wall mountable component comprising a tube having means to facilitate its mounting to a wall; and (iii) a sheath adapted to be retained on said wall mountable component, said sheath including an opening to enable releasable engagement thereof with the head portion of the door mountable component, and wherein cushioning means are associated with said sheath to cushion the door mountable component and the sheath relative to each other when being engaged and once engaged.

The head portion on the door mountable component is preferably substantially spherical in shape and the opening in the sheath defines a complimentary shaped spherical cavity.

The wall mountable component preferably comprises a cylindrical tube having a transverse wall formed in one end thereof, which transverse wall has an aperture to enable fitment to a wall by means of a screw or other fixing pin.

The cushioning means may include any number of ways to cushion including the use of foam, etc. Preferably, the cushioning means is a series of circumferential ribs which can resiliently deform during operation.

Preferred embodiments of the invention will now be described by way of example with reference to the accompanying drawings, in which:

FIG. 1 is an exploded perspective view of the door and wall mountable components of a device for releasably holding doors;

FIG. 2 is a partial cross-sectional side view of the device of FIG. 1;

Figure 3:
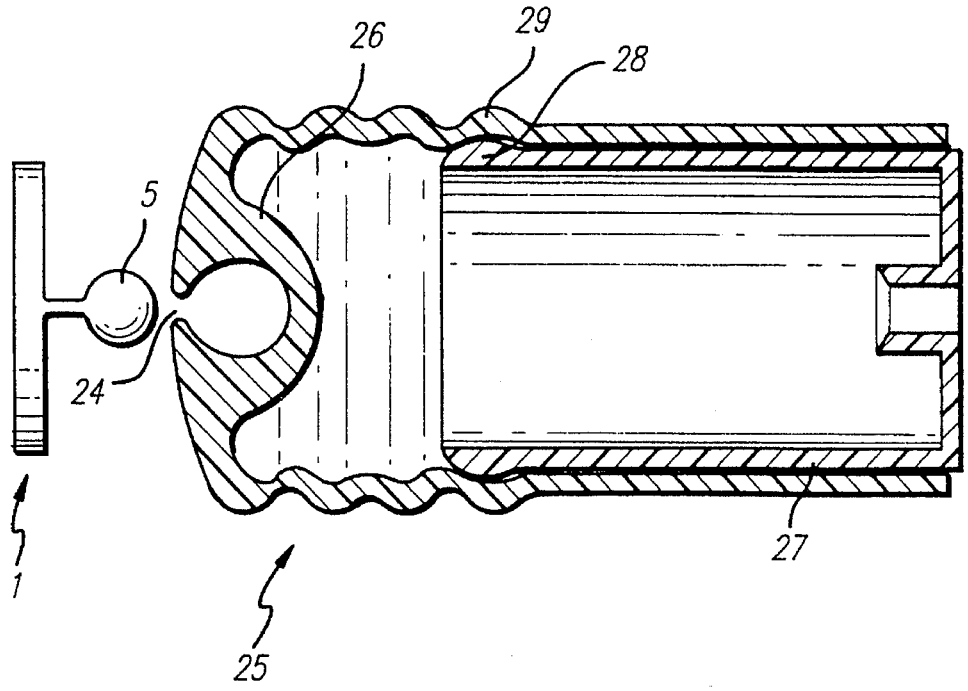
FIG. 3 is a partial cross-sectional view of another device according to the invention in disengagement.

With reference to FIG. 1, there is shown a first component 1. The first component 1 has a base 6 and an engagement member which protrudes at right angles therefrom. The engagement member comprises a leg portion 3, a neck portion 4, and a head portion 5. The leg portion 3 and the neck portion 4 are substantially cylindrical in shape whereas the head portion 5 is spherical. The width dimension of the neck portion 4 is smaller than the width dimension of the leg portion 3 and the diameter of the head portion 5. The base 6 is attached to the back of a door by screws which pass through the holes 2 located either side of the engagement member. The first component 1 is made of plastic.

The second component 7 comprises a mating portion 7A and an attachment portion 7B. The second component 7 is substantially cylindrical in shape with a domed facing end and a flat attachment face 11. The mating portion 7A is substantially cylindrical in shape and has at one end the domed facing end. The domed facing end has an opening 14. The mating portion 7A also has a series of circumferential ribs 10 located adjacent the domed facing end. The attachment portion 7B is also substantially cylindrical and is such that it can serve as an internal sleeve and be secured within mating portion 7A. The mating portion 7A is secured to the attachment portion 7B by placing a pin 13 through holes 8 and 16. The attachment portion 7B has an attachment face 11. The attachment face 11 has a central hole 12 through which a screw may pass and attach the attachment portion 7B to a wall. The second component 7 is made from an injection moulded plastics material.

With reference to FIG. 2, the first component 1 is engaged with the second component 7. The head portion 5 of the first component 1 is held by the opening 14 of the second component 7. Transverse ribs 15 on the internal surface of the mating portion 7A assist in the engagement of the first component 1.

In use, the first component 1 engages with the second component 7 when the head portion 5 passes through opening 14. The first component 1 is held by the mating portion 7A because the width diameter of the neck portion 4 is smaller than the width diameter of the leg portion 3 and the diameter of the head portion 5. The first component 1 is rigidly held until a substantial force is used to release the first and second components from each other. The ribs 10 and adjacent troughs serve to cushion the engagement and cushion the door from the wall by resilient deformation should the door move because of wind or other forces during engagement of the two components.

The domed end face can also deform and therefore precise alignment of the first and second components is not required. If the component is slightly mis-aligned, the head portion 5 will strike the domed end face and deform it causing the opening 14 to move to the head portion 5 and engage it.

As described, the second component 7 has a pin 13 which secures the mating portion 7A to the attachment portion 7B and serves to prevent undesirable removal such as theft of the mating portion 7A.

Figure 4:
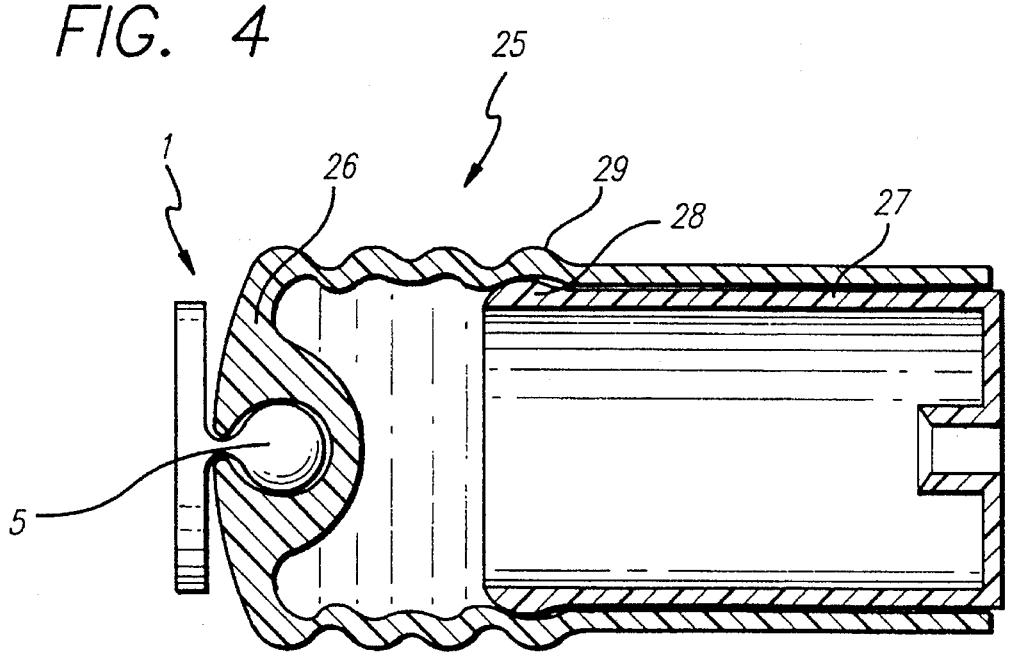
FIG. 4 is a partial cross-sectional view of the device of FIG. 3 in engagement.

FIGS. 3 and 4 illustrate a modified version of the device of FIGS. 1 and 2. In this modified version, the opening 24 in the second component 25 is surrounded by a wall structure 26 which provides a firm grip on the head portion 5 of the first component 1 and is less subject to permanent deformation after continued use than the opening in the previously described embodiment.

The modified version also incorporates a different means for connecting the second component 25 to attachment portion 27. This comprises a purely frictional engagement between a lip 28 on the end of the attachment portion and a rib 29 formed in the second component. This connection means facilitates the location of the device in situ and is more economical to manufacture.

It should be realised that various changes and modifications may be made to the embodiment without departing from the spirit and scope of the invention.

The claims defining the invention are as follows:

1. A door stop comprising:

(i) a door mountable component having a base portion, a neck portion and a head portion, wherein the width of the neck portion is smaller than the width of the head portion, and wherein the base portion provides an anchor point to a door;

(ii) a wall mountable component comprising a tube having means to facilitate its mounting to a wall; and (iii) a sheath adapted to substantially enclosed and be retained by said wall mountable component, said sheath including an opening to enable releasable engagement thereof with the head portion of the door mountable component, and wherein cushioning means are formed integrally in the wall of said sheath to cushion the door mountable component and the sheath relative to each other when being engaged and once engaged.

2. A door stop as claimed in claim 1, wherein the head portion on the door mountable component is substantially spherical in shape and the opening in the sheath defines a complimentary shaped spherical cavity.

3. A door stop as claimed in claim 1, wherein the wall mountable component comprises a cylindrical tube having a transverse wall formed in one end thereof, which transverse wall has an aperture to enable fitment to a wall by means of a screw or other fixing pin.

4. A door stop as claimed in claim 1, wherein the cushioning means is fabricated from resiliently deformable material.

5. A door stop as claimed in claim 4, wherein the cushioning means comprises a plurality of circumferential ribs which resiliently deform when the door mountable component and sheath are brought together.

* * * * *